US006460371B2

(12) United States Patent
Kawada

(10) Patent No.: US 6,460,371 B2
(45) Date of Patent: Oct. 8, 2002

(54) MULTISTAGE COMPRESSION REFRIGERATING MACHINE FOR SUPPLYING REFRIGERANT FROM SUBCOOLER TO COOL ROTATING MACHINE AND LUBRICATING OIL

(75) Inventor: Akihiro Kawada, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/904,891

(22) Filed: Jul. 16, 2001

(65) Prior Publication Data

US 2002/0050149 A1 May 2, 2002

(30) Foreign Application Priority Data

Oct. 13, 2000 (JP) ..... 2000-312959

(51) Int. Cl.[7] ..... F25B 31/00; F25B 1/10
(52) U.S. Cl. ..... 62/505; 62/510
(58) Field of Search ..... 62/510, 505, 468

(56) References Cited

U.S. PATENT DOCUMENTS

| | | | | | |
|---|---|---|---|---|---|
| 2,277,647 | A | * | 3/1942 | Jones | 62/510 |
| 2,921,446 | A | * | 1/1960 | Zulinke | 62/505 |
| 3,022,638 | A | * | 2/1962 | Caswell et al. | 62/510 |
| 3,789,249 | A | * | 1/1974 | Purman | 310/54 |
| 3,848,422 | A | | 11/1974 | Schibbye | |
| 4,254,637 | A | * | 3/1981 | Brauch et al. | 62/468 |
| 4,594,858 | A | * | 6/1986 | Shaw | 62/175 |
| 4,947,655 | A | * | 8/1990 | Shaw | 62/200 |
| 5,065,590 | A | * | 11/1991 | Powell et al. | 62/175 |
| 5,899,091 | A | * | 5/1999 | Fraser et al. | 62/473 |
| 6,070,421 | A | * | 6/2000 | Petrovich et al. | 62/210 |
| 6,158,240 | A | * | 12/2000 | Low et al. | 62/611 |

FOREIGN PATENT DOCUMENTS

| | | |
|---|---|---|
| EP | 0 658 730 | 6/1995 |
| JP | 5-322334 | 12/1993 |
| JP | 10-292948 | 11/1998 |
| JP | 11-132581 | 5/1999 |
| JP | 11-344265 | 12/1999 |

* cited by examiner

*Primary Examiner*—William C. Doerrler
(74) *Attorney, Agent, or Firm*—Oblon, Spivak, McClelland, Maier & Neustadt, P.C.

(57) ABSTRACT

A multistage compression refrigerating machine is disclosed, which efficiently cools a rotating machine such as an electric motor and lubricating oil by using a refrigerant and increases the amount of refrigerant to be used to provide the refrigerating capacity in the evaporator, thereby improving the refrigerating capacity. The machine comprises a condenser for supplying a condensed refrigerant to an evaporator via a subcooler: a multistage compression system for absorbing the above refrigerant, absorbing a refrigerant evaporated from the subcooler, from an intermediate position between adjacent compressors, compressing the absorbed refrigerants together, and discharging it to the condenser; a rotating-machine cooler for cooling a rotating machine for driving the multistage compression system; and a lubricating-oil cooler for cooling lubricating oil. The refrigerant extracted from the subcooler is supplied to the rotating-machine cooler and the lubricating-oil cooler, and this refrigerant is returned to the evaporator after cooling.

3 Claims, 3 Drawing Sheets

MULTISTAGE COMPRESSION REFRIGERATING MACHINE FOR SUPPLYING REFRIGERANT FROM SUBCOOLER TO COOL ROTATING MACHINE AND LUBRICATING OIL

BACKGROUND OF THE INVENTION

1. Field of the Invention

The present invention relates to a multistage compression refrigerating machine such as a centrifugal chiller, screw chiller, or the like.

2. Description of the Related Art

Multistage compression refrigerating machines are widely used in air conditioning systems of general buildings, factories, and the like. For example, the two-stage compression refrigerating machine as shown in FIG. 3 comprises an evaporator 51, a first-stage compressor 53 and a second-stage compressor 54 which are rotationally driven by an electric motor 52 (abbreviated to the motor 52, hereinbelow), a condenser 55, a subcooler 56, a motor cooler 57 for cooling the motor 52 by using a refrigerant, and a lubricating-oil cooler 58 for cooling lubricating oil by using a refrigerant.

In the evaporator 51, a liquid refrigerant is heated by cold water 60 having a temperature of 12° C. passing through a tube 59, so that vaporized refrigerant 61 is generated. In this process, the cold water 60 is cooled to approximately 7° C. thorough the heat exchange in the evaporator 51, and it is then delivered outside. Therefore, the temperature in the evaporator 51 is maintained to be approximately 5° C.

The vaporized refrigerant 61 generated in the evaporator 51 is supplied to the first-stage compressor 53 and second-stage compressor 54, and the supplied refrigerant is two-stage-compressed by using impellers which are rotated by the motor 52, thereby discharging high-temperature and high-pressure vaporized refrigerant 61*a*. Here, vaporized refrigerant 61*b* from the subcooler 56 is also introduced (or supplied) into a path between the first-stage and second-stage compressors 53 and 54 (i.e., the upstream side of the second-stage compressor 54), and the supplied vaporized refrigerant 61*b* is also compressed together with the vaporized refrigerant 61 from the evaporator 51.

In the condenser 55, the high-temperature and high-pressure vaporized refrigerant 61*a* discharged from the second-stage compressor 54 is cooled using cooling water 63 which flows through a tube 62, thereby condensing the vaporized refrigerant 61*a* into a liquid. In this process, the cooling water 63 is heated through the heat exchange in the condenser 55 and is then discharged outside. The condensed liquid refrigerant 64 is collected at the bottom of the condenser 55; thus, the temperature inside the condenser 55 is approximately 40° C.

The pressure of the liquid refrigerant 64*a* supplied from the condenser 55 is reduced to an intermediate pressure by using a first-stage expansion valve 65, so that the refrigerant 64*a* is expanded, and a portion of the expanded refrigerant is output from the subcooler 56 as vaporized refrigerant 61*b*. As explained above, this vaporized refrigerant 61*b* is supplied to an intermediate position between the first-stage compressor 53 and the second-stage compressor 54. On the other hand, the pressure of the remaining refrigerant 64*a* cooled through the evaporation of the refrigerant 64*a* is further reduced using a second-stage expansion valve 66 and is then supplied to the evaporator 51.

In addition, a portion 64*b* of the refrigerant 64, which is collected at the bottom of the condenser 55, is used for cooling the motor 52 and the lubricating oil. More specifically, the refrigerant 64*b* is first supplied to the lubricating-oil cooler 58 so as to cool the lubricating oil and is then supplied to the motor cooler 57 so as to cool the motor 52. After that, the refrigerant 64*b* including a vaporized portion is returned to the evaporator 51.

However, in the conventional multistage compression refrigerating machines, the refrigerant 64*b* (a portion of the liquid refrigerant 64) collected at the bottom of the condenser 55 having a temperature of approximately 40° C. is used for cooling the motor 52 and the lubricating oil, and the refrigerant 64*b* after the cooling process is returned to the evaporator 51 whose inner temperature is approximately 5° C. Therefore, the liquid refrigerant 64*b* expands due to a pressure difference between the condenser 55 and the evaporator 51, and as a result, the refrigerant 64*b* evaporates in the evaporator 51. Accordingly, the amount of the liquid refrigerant to be used to provide or increase the refrigerating capacity is reduced, thereby decreasing the refrigerating capacity.

SUMMARY OF THE INVENTION

In consideration of the above circumstances, an object of the present invention is to provide a multistage compression refrigerating machine for efficiently cooling a rotating machine such as an electric motor and lubricating oil by using a refrigerant and increasing the amount of refrigerant to be used to provide the refrigerating capacity in the evaporator, thereby improving the refrigerating capacity.

Therefore, the present invention provides a multistage compression refrigerating machine comprising:

an evaporator;

a condenser for condensing a refrigerant and supplying the condensed refrigerant to the evaporator via a subcooler:

a multistage compression system having a plurality of compressors which are connected in series, for:

receiving the refrigerant evaporated in the evaporator;

receiving a refrigerant evaporated from the subcooler, from an intermediate position between adjacent compressors in the multistage compression system; and compressing the received refrigerants together and discharging the compressed refrigerant to the condenser;

a rotating machine for driving the multistage compression system;

a rotating-machine cooler for cooling the rotating machine; and a lubricating-oil cooler for cooling lubricating oil for lubricating the rotating machine, and wherein:

the refrigerant extracted from the subcooler is supplied to the rotating-machine cooler and the lubricating-oil cooler, and this refrigerant is returned to the evaporator after cooling.

According to the present invention, the rotating machine and the refrigerant can be efficiently cooled, and the amount of the liquid refrigerant (in the evaporator) to be used to provide or increase the refrigerating capacity can be reduced, thereby improving the refrigerating capacity and reducing the running cost.

It is possible that:

one or more subcoolers connected in series are provided for supplying the evaporated refrigerant from each subcooler to each intermediate position between adjacent compressors of the multistage compression system; and the refrigerant supplied to the lubricating-oil cooler and the rotation-machine cooler is extracted from the subcooler positioned at a position most downstream of the subcoolers connected in series.

In this case, the refrigerant capacity can be further improved and the cost can be further reduced.

Typically, the rotating machine is an electric motor.

DESCRIPTION OF THE PREFERRED EMBODIMENTS

Hereinafter, embodiments according to the present invention will be explained in detail with reference to the drawings.

Figure 1:
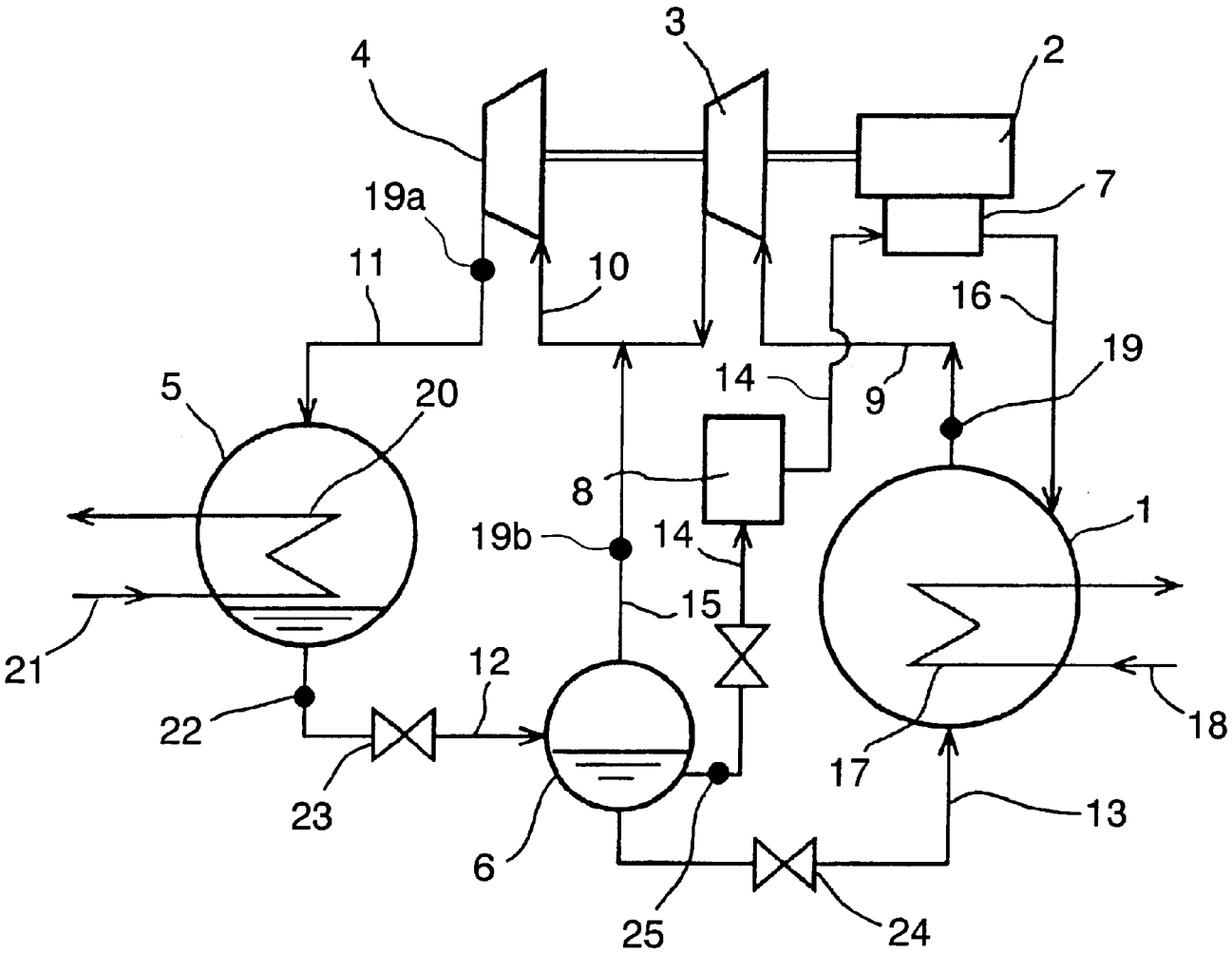
FIG. 1 is a diagram showing the general structure of a multistage compression refrigerating machine of the first embodiment according to the present invention.

FIG. 1 is a diagram showing the general structure of a multistage compression refrigerating machine of the first embodiment according to the present invention. In this multistage compression refrigerating machine having a two-stage compressor system, (i) a refrigerant condensed in a condenser is supplied via a subcooler to an evaporator, (ii) first vaporized refrigerant obtained by evaporating the refrigerant in the evaporator is received by the two-stage compressor system, (iii) second vaporized refrigerant obtained by evaporating the refrigerant through the subcooler is received from an intermediate position between the two stages, (iv) and the first vaporized refrigerant and the second vaporized refrigerant are compressed and discharged into a condenser.

Therefore, as shown in FIG. 1, the multistage compression refrigerating machine in the present embodiment comprises an evaporator 1, a first-stage compressor 3 and a second-stage compressor 4 which are rotationally driven by an electric motor 2 (abbreviated to the motor 2, hereinbelow), a condenser 5, a subcooler 6, a motor cooler 7 for cooling the motor 2 by using a refrigerant, and a lubricating-oil cooler 8 for cooling lubricating oil by using a refrigerant.

The evaporator 1 and the first-stage compressor 3 are joined to each other via a pipe line 9. The first-stage compressor 3 and the second-stage compressor 4 are joined to each other via a pipe line 10. The second-stage compressor 4 and the condenser 5 are joined to each other via a pipe line 11. The condenser 5 and the subcooler 6 are joined to each other via a pipe line 12. The subcooler 6 and the evaporator 1 are joined to each other via a pipe line 13. The subcooler 6, the lubricating-oil cooler 8, and the motor cooler 7 are joined to each other via a pipe line 14. The subcooler 6, the first-stage compressor 3, the second-stage compressor 4 are joined to each other via a pipe line 15 and the pipe line 10, and the motor cooler 7 and the evaporator 1 are joined to each other via a pipe line 16.

In the evaporator 1, cold water 18 having a temperature of 12° C. passes through a tube 17 which is arranged in the evaporator 1, as shown in FIG. 1, and a liquid refrigerant is heated by the cold water 18, so that vaporized refrigerant 19 is generated. In this process, the cold water 18 is cooled to approximately 7° C. thorough the heat exchange in the evaporator 1, and it is then delivered outside the evaporator 1. As a result, the temperature of the evaporator 1 is approximately 5° C.

The vaporized refrigerant 19 generated in the evaporator 1 is supplied to into the first-stage compressor 3 and second-stage compressor 4 via the pipe line 9, and the supplied refrigerant is compressed by using an impeller of the first-stage compressor 3 which is rotated by the motor 2. This compressed vaporized refrigerant is supplied to the second-stage compressor 4 via the pipe line 10 and is further compressed by using an impeller of the second-stage compressor 4, thereby discharging high-temperature and high-pressure vaporized refrigerant 19*a*. Here, vaporized refrigerant 19*b* from the subcooler 6 via the pipe line 15 is also introduced (or supplied) into an intermediate position of the pipe line 10 between the first-stage and second-stage compressors 3 and 4 (i.e., the upstream side of the second-stage compressor 4), and the supplied vaporized refrigerant 19*b* is also compressed together with the vaporized refrigerant 19 from the evaporator 1.

In the condenser 5, cooling water 21 passes through a tube 20 which is arranged in the condenser 5, as shown in FIG. 1. The high-temperature and high-pressure vaporized refrigerant 19*a* discharged from the second-stage compressor 4 and supplied via the pipe line 11 is cooled using the cooling water 21, thereby condensing the vaporized refrigerant 19*a* into a liquid. In this process, the cooling water 21 is heated through the heat exchange in the condenser 5 and is then discharged outside the condenser 5. The condensed liquid refrigerant 22 is collected at the bottom of the condenser 5. As a result, the temperature inside the condenser 5 is approximately 40° C.

The subcooler 6 is provided for maintaining a specific pressure difference between the condenser 5 and the evaporator 1, evaporating a portion of the refrigerant 22, and increasing latent heat in the evaporator 1. Therefore, in the subcooler 6, the pressure of the liquid refrigerant 22 supplied from the condenser 5 is reduced to an intermediate pressure by using a first-stage expansion valve 23 provided in the middle of the pipe line 12, so that the refrigerant 22 is expanded. A portion of the expanded refrigerant is used as vaporized refrigerant 19*b*. As explained above, this vaporized refrigerant 19*b* is supplied to the pipe line 10 between the first-stage compressor 3 and the second-stage compressor 4. On the other hand, the pressure of the remaining refrigerant cooled through the evaporation of the refrigerant 22 is further reduced using a second-stage expansion valve 24 in the middle of the pipe line 13 and is then supplied to the evaporator 1. As a result, the temperature inside the subcooler 6 is approximately 20° C.

In addition, a portion of the refrigerant 22 in the subcooler 6 is extracted as refrigerant 25 used for cooling the motor 2 and the lubricating oil. More specifically, the refrigerant 25 is first supplied to the lubricating-oil cooler 8 via the pipe line 14 and the like so as to cool the lubricating oil and is then further supplied to the motor cooler 7 so as to cool the motor 2. After that, the refrigerant 25 including a vaporized portion is returned to the evaporator 1 via the pipe line 16.

As explained above, in the two-stage compression refrigerating machine in the first embodiment, as shown in FIG. 1, a portion of the liquid refrigerant 22 of the subcooler 6 is extracted, where the temperature of the subcooler 6 is approximately 20° C. which is lower than the temperature of the condenser 5 (i.e., 40° C.), and the pressure difference between the subcooler 6 and the evaporator 1 is lower than that between the condenser 5 and the evaporator 1. This extracted liquid refrigerant 25 is used for cooling the motor 2 and the lubricating oil, and after cooling, the refrigerant is returned to the evaporator 1 whose inner temperature is approximately 5° C. Therefore, the amount of the liquid refrigerant 25 which expands due to a pressure difference between the intercooler 6 and the evaporator 1 is smaller in comparison with the case in which the refrigerant is taken from the condenser 5.

Therefore, the amount of the liquid refrigerant, which evaporates in the evaporator 1 and thus can be used to provide or increase the refrigerating capacity, is increased, and the flow rate of the refrigerant per unit refrigerating capacity is reduced. Accordingly, the COP (coefficient of performance) can be improved and a two-stage compression refrigerating machine having a superior refrigerating efficiency can be obtained. Here, the COP is defined as "the refrigerating capacity/the motor input".

Figure 2:
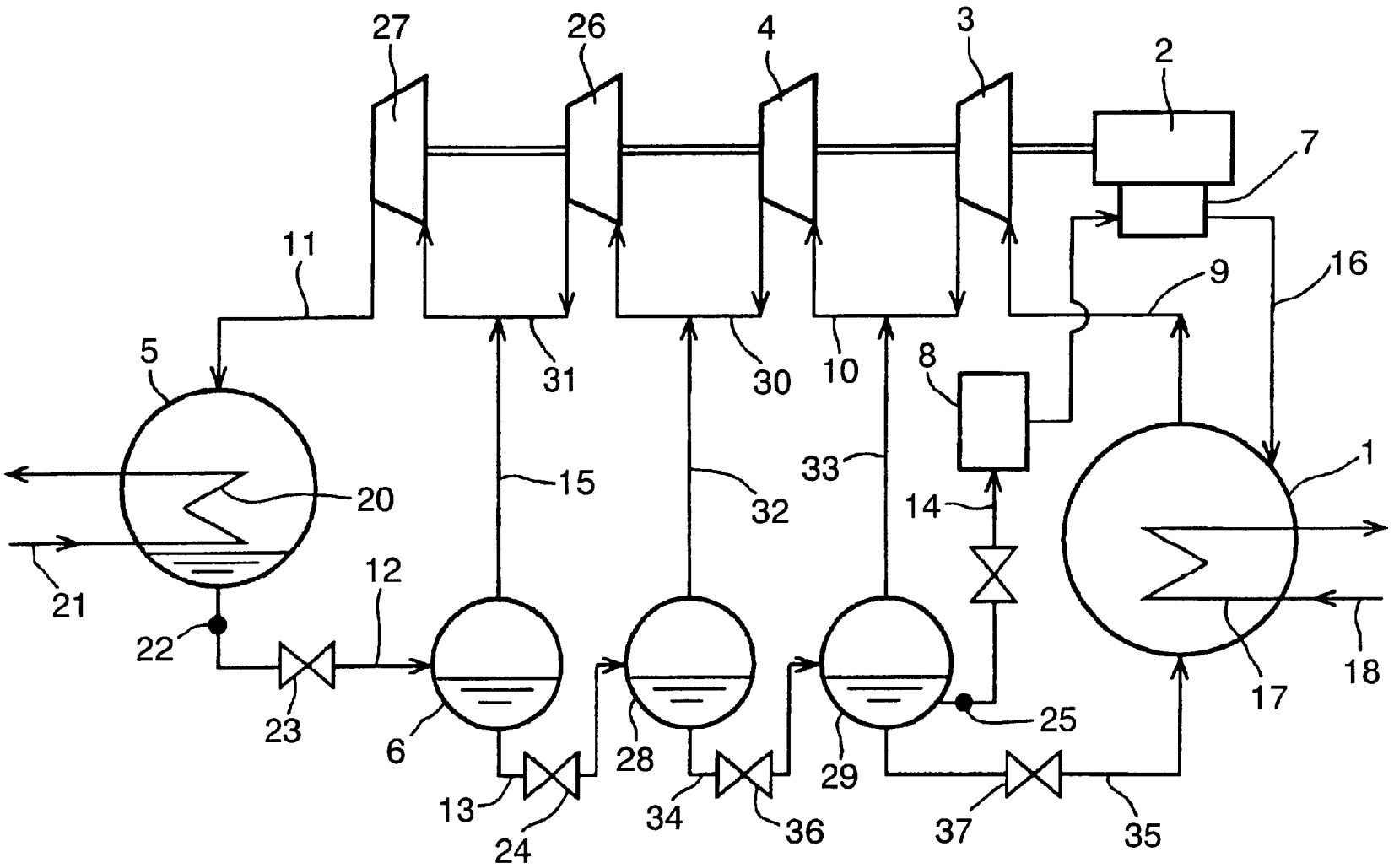
FIG. 2 is a diagram showing the general structure of a multistage compression refrigerating machine of the second embodiment according to the present invention.
Figure 3:
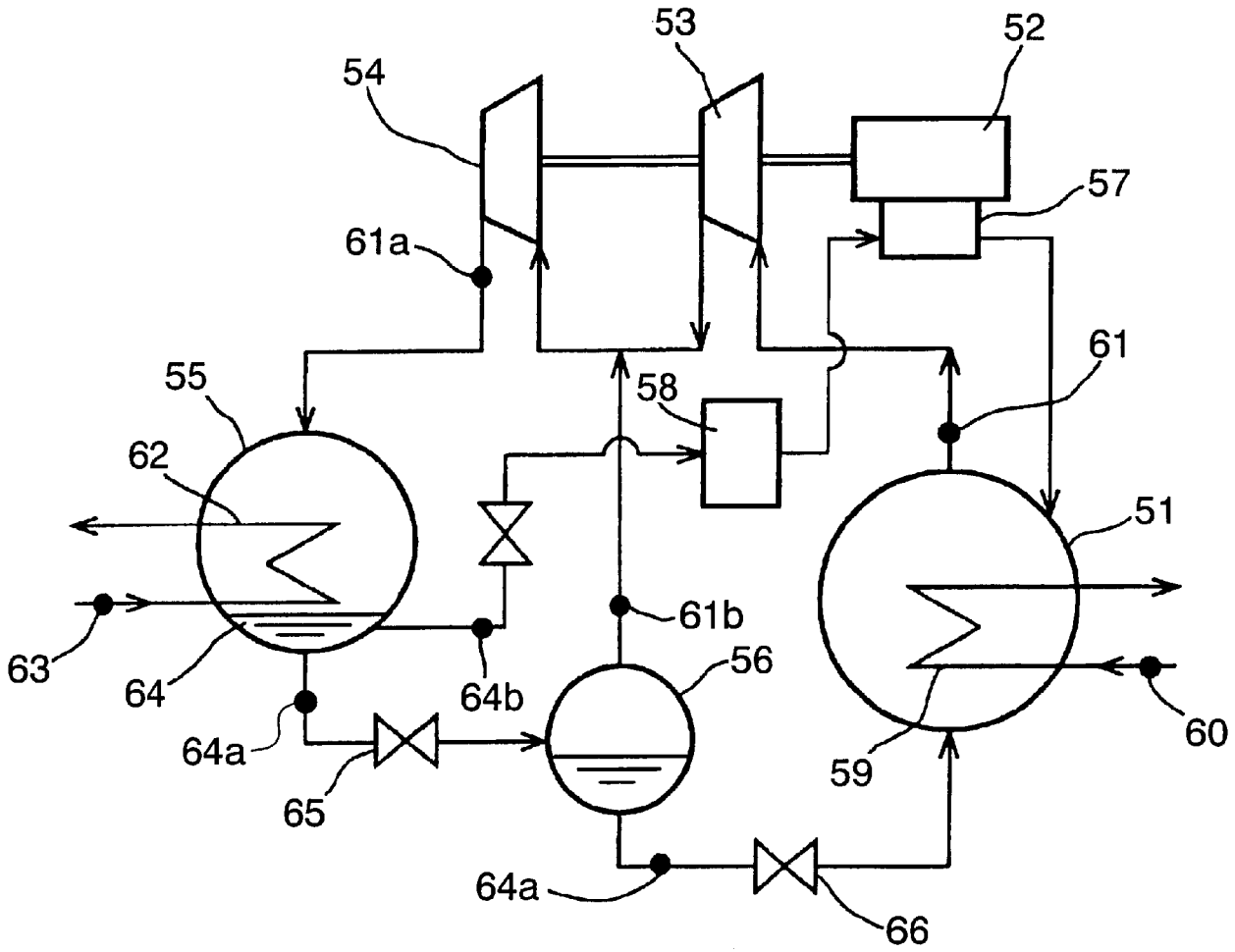
Fig. 3 PRIOR ART
FIG. 3 is a diagram showing the general structure of a conventional multistage compression refrigerating machine.

FIG. 2 is a diagram showing the structure of the multistage compression refrigerating machine of the second embodiment according to the present invention. The distinctive feature of the second embodiment in comparison with the first embodiment is the provision of a four-stage compression refrigerating machine having a third-stage compressor 26 and a fourth-stage compressor 27 in addition to the first-stage compressor 3 and the second-stage compressor 4. Therefore, two subcoolers 28 and 29, pipe lines 30 to 35 for joining these elements, and third and fourth expansion valves 36 and 37 are also added in the second embodiment.

The pressure in the subcoolers 28 and 29 provided at the downstream side of the subcooler 6 which is provided immediately after the condenser 5 is further reduced using the expansion valves 24 and 36, and these subcoolers 28 and 29 are cooled through the evaporation of the refrigerant 22 through the subcoolers 6 and 28. Therefore, the temperature of the subcooler 28 is approximately 15° C., and the temperature of the subcooler 29 is approximately 10° C.

The refrigerant 25 extracted from the subcooler 29 at the most downstream side is used for cooling the motor 2 and the lubricating oil. The other structural elements and functions are similar to those of the first embodiment.

As shown in FIG. 2, in the four-stage compression refrigerating machine of the second embodiment, a portion of the refrigerant 22 of the subcooler 29 at the most downstream side is extracted, where the temperature of the subcooler 29 is approximately 10° C., which is considerably lower than the temperature of the condenser 5, that is, approximately 40° C., and the pressure difference between the subcooler 29 and the evaporator 1 is much smaller. This extracted refrigerant 25 is used for cooling the motor 2 and the lubricating oil, and after cooling, the refrigerant is returned to the evaporator 1 having an inner temperature of approximately 5° C. Therefore, the amount of the refrigerant (for cooling) which self-expands due to the pressure difference between the subcooler 29 and the evaporator 1 is much more reduced in comparison with the case in which the refrigerant for cooling is taken from the condenser 5. Accordingly, the amount of the liquid refrigerant which evaporates in the evaporator 1 and is used to provide the refrigerating capacity is considerably increased. As a result, the flow rate of the refrigerant per unit refrigerating capacity is reduced and the COP is increased, thereby obtaining a four-stage compression refrigerating machine having a superior refrigerating efficiency.

The embodiments of the present invention have been explained above. However, the present invention is not limited to these embodiments, and various variations and modifications are possible within the scope and spirit of the present invention.

For example, the number of stages of the multistage compression refrigerating machine is not limited to two or four in the above embodiments, and three or more than four is also possible.

In addition, the rotating machine is an electric motor in the above embodiment. However, the present invention can be applied to multistage compression refrigerating machines employing other kinds of rotating machine, such as a gas engine, Diesel engine, steam turbine, gas turbine, and the like.

What is claimed is:

1. A multistage compression refrigerating machine comprising:

an evaporator;

a condenser for condensing a refrigerant and supplying the condensed refrigerant to the evaporator via a subcooler;

a multistage compression system having a plurality of compressors which are connected in series, for:

receiving the refrigerant evaporated in the evaporator;

receiving a refrigerant evaporated from the subcooler, from an intermediate position between adjacent compressors in the multistage compression system; and compressing the received refrigerants together and discharging the compressed refrigerant to the condenser;

a rotating machine for driving the multistage compression system;

a rotating-machine cooler for cooling the rotating machine; and a lubricating-oil cooler for cooling lubricating oil for lubricating the rotating machine, and wherein:

the liquid refrigerant extracted from the subcooler is supplied to the rotating-machine cooler and the lubricating-oil cooler, and this refrigerant is returned to the evaporator after cooling.

2. A multistage compression refrigerating machine as claimed in claim 1, wherein one or more subcoolers connected in series are provided for supplying the evaporated refrigerant from each subcooler to each intermediate position between adjacent compressors of the multistage compression system; and the refrigerant supplied to the lubricating-oil cooler and the rotation-machine cooler is extracted from the subcooler positioned at a position most downstream of the subcoolers connected in series.

3. A multistage compression refrigerating machine as claimed in claim 1, wherein the rotating machine is an electric motor.

* * * * *